US008092271B2

(12) United States Patent
Garbos et al.

(10) Patent No.: US 8,092,271 B2
(45) Date of Patent: Jan. 10, 2012

(54) INTERACTIVE TOY WITH POSITIONAL SENSOR

(75) Inventors: Jennifer R. Garbos, Kansas City, MO (US); Rebecca A. Hottel, Kansas City, MO (US); Nancy Lynn Short, Roeland Park, KS (US); Timothy Roger Staley, Lenexa, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 770 days.

(21) Appl. No.: 11/962,081

(22) Filed: Dec. 20, 2007

(65) Prior Publication Data

US 2009/0163111 A1 Jun. 25, 2009

(51) Int. Cl.
*A63F 3/28* (2006.01)

(52) U.S. Cl. ..... 446/298; 446/268

(58) Field of Classification Search ..... 446/298
See application file for complete search history.

(56) References Cited

U.S. PATENT DOCUMENTS

| | | | | | |
|---|---|---|---|---|---|
| 1,274,670 | A | | 8/1918 | Brackett | |
| 1,662,979 | A | | 5/1927 | Nelson | |
| 2,427,442 | A | * | 9/1947 | Campbell | 446/132 |
| 3,672,096 | A | * | 6/1972 | Johmann | 446/338 |
| 3,831,163 | A | | 8/1974 | Byers | |
| 3,851,418 | A | * | 12/1974 | Barlow et al. | 446/338 |
| 4,591,676 | A | | 5/1986 | Jackman et al. | |
| 4,628,160 | A | | 12/1986 | Canevari | |
| 4,843,497 | A | | 6/1989 | Leyden | |
| 4,846,693 | A | | 7/1989 | Baer | |
| 4,850,930 | A | | 7/1989 | Sato et al. | |
| 4,961,575 | A | * | 10/1990 | Perry | 273/460 |
| 5,285,033 | A | | 2/1994 | Ipcinski | |
| 5,312,287 | A | * | 5/1994 | Chuang | 446/295 |
| 5,415,579 | A | | 5/1995 | Pracas | |
| 5,458,524 | A | | 10/1995 | Lucas | |
| 5,808,254 | A | | 9/1998 | Wu | |
| 5,820,441 | A | | 10/1998 | Pracas | |
| 5,912,454 | A | * | 6/1999 | Castillo et al. | 250/205 |
| 5,944,533 | A | * | 8/1999 | Wood | 434/322 |
| 5,975,979 | A | * | 11/1999 | Ferri Llorens | 446/301 |
| 6,048,209 | A | | 4/2000 | Bailey | |
| 6,053,797 | A | | 4/2000 | Tsang et al. | |
| 6,139,394 | A | | 10/2000 | Maxim | |
| 6,149,490 | A | * | 11/2000 | Hampton et al. | 446/353 |
| 6,198,059 | B1 | | 3/2001 | Jou | |
| 6,322,420 | B1 | | 11/2001 | Daniellian | |
| 6,371,826 | B1 | | 4/2002 | Pestonji | |
| 6,454,625 | B1 | | 9/2002 | Fong et al. | |
| 6,463,257 | B1 | | 10/2002 | Wood | |
| 6,494,457 | B2 | | 12/2002 | Conte et al. | |
| 6,497,607 | B1 | | 12/2002 | Hampton et al. | |
| 6,514,117 | B1 | | 2/2003 | Hampton et al. | |
| 6,527,611 | B2 | * | 3/2003 | Cummings | 446/175 |

(Continued)

*Primary Examiner* — Melba Bumgarner
*Assistant Examiner* — Tramar Harper
(74) *Attorney, Agent, or Firm* — Shook, Hardy & Bacon L.L.P.

(57) ABSTRACT

An interactive toy for playing a game with a user of the toy includes electrical components for producing audible messages to instruct user actions. The toy also includes a hat having a brim movable between up and down positions. The position of the brim determines the play sequence of the toy and the audible messages played thereby by way of an activation mechanism. The toy is switched between "hide me" and "locate me" modes based on the position of the brim. An abbreviated trial mode is provided by way of a removable pull tab.

18 Claims, 7 Drawing Sheets

U.S. PATENT DOCUMENTS

| | | | | |
|---|---|---|---|---|
| 6,537,128 | B1 | 3/2003 | Hampton et al. | |
| 6,544,098 | B1 | 4/2003 | Hampton et al. | |
| 6,565,407 | B1 | 5/2003 | Woolington et al. | |
| 6,641,454 | B2 | 11/2003 | Fong et al. | |
| 6,663,393 | B1 | 12/2003 | Ghaly | |
| 6,702,644 | B1 | 3/2004 | Hornsby et al. | |
| 6,705,919 | B2 | 3/2004 | Curran et al. | |
| 6,706,978 | B2 | 3/2004 | Wagatsuma et al. | |
| 6,882,824 | B2 | 4/2005 | Wood | |
| 6,905,391 | B2 * | 6/2005 | Soto et al. | 446/397 |
| 7,035,583 | B2 | 4/2006 | Ferrigno et al. | |
| 2003/0103020 | A1 | 6/2003 | Kim | |
| 2003/0129922 | A1 | 7/2003 | Curran et al. | |
| 2003/0162475 | A1 | 8/2003 | 'Pratte et al. | |
| 2003/0198927 | A1 | 10/2003 | Campbell | |
| 2004/0161732 | A1 | 8/2004 | Stump et al. | |
| 2004/0180603 | A1 | 9/2004 | Barri et al. | |
| 2004/0197764 | A1 | 10/2004 | Stump et al. | |
| 2004/0198158 | A1 | 10/2004 | Driscoll et al. | |
| 2004/0204240 | A1 | 10/2004 | Barney | |
| 2004/0249510 | A1 | 12/2004 | Hanson | |
| 2005/0142984 | A1 | 6/2005 | Kiyosue | |
| 2005/0154594 | A1 | 7/2005 | Beck | |
| 2005/0227577 | A1 | 10/2005 | McRae | |
| 2006/0017543 | A1 | 1/2006 | Feinberg | |
| 2006/0027447 | A1 | 2/2006 | Lo | |
| 2006/0084362 | A1 | 4/2006 | Ghaly | |
| 2006/0094332 | A1 | 5/2006 | Ghaly | |
| 2007/0087655 | A1 * | 4/2007 | Rifkin | 446/268 |
| 2008/0102729 | A1 * | 5/2008 | Ekstein-Lieberman | 446/297 |

* cited by examiner

INTERACTIVE TOY WITH POSITIONAL SENSOR

CROSS-REFERENCE TO RELATED APPLICATIONS

Not applicable.

STATEMENT REGARDING FEDERALLY SPONSORED RESEARCH OR DEVELOPMENT

Not applicable.

BRIEF SUMMARY OF THE INVENTION

The present invention relates to an interactive toy. More particularly, this invention relates to a toy having electronic components therein for producing audible phrases which direct a user in playing with the toy.

The toy includes a body having an interior cavity in which the electrical components are concealed. A user engagable activation switch is provided to initiate interaction with the toy. In the present embodiment the toy is programmed to direct a user to interact with the toy as part of a hide and seek game.

The toy has a user moveable feature through which the user can activate the play sequence of the toy. In the illustrated embodiment, the user moveable feature is a brim of a hat positioned on the head of the toy. If the toy is activated with the brim in the up position of FIG. 1, the toy plays audible messages directing the user to hide the toy. Once the user has found a suitable location for hiding the toy, the user then moves the brim of the hat to a down position to initiate an alternate "find me" play sequence.

The toy then periodically produces audible phrases directing a seeker to find the toy. Upon finding the toy, the seeker moves the brim back to its up position thereby activating the initial "hide me" sequence after the seeker has been informed that they were successful in finding the toy.

The moveable feature visibly indicates to a child the condition or play sequence in which the toy is operating. In the illustrated embodiment, the visual representation of the play sequence is enhanced by the fact that the brim of the hat covers eyes of the toy when the toy is hidden and in the "find me" sequence.

Accordingly, the position of the moveable feature determines the play sequence of the toy. In the illustrated embodiment, the position of the moveable feature is ascertained electronically by way of an activation mechanism having a magnetic field sensor or magnetic reed switch used in connection with a magnet. When the magnet is close to the magnetic switch, the circuit is closed and when the magnet is moved away from the magnetic switch, the circuit is open. The play sequence is determined by the state of the magnetic switch.

Further objects, features and advantages of the present invention over the prior art will become apparent from the detailed description of the drawings which follows, when considered with the attached figures.

BRIEF DESCRIPTION OF THE SEVERAL VIEWS OF THE DRAWINGS

The features of the invention noted above are explained in more detail with reference to the embodiments illustrated in the attached drawing figures, in which like reference numerals denote like elements, in which FIGS. 1-12 illustrate one of several possible embodiments of the present invention, and in which:

FIG. 1 is a front perspective view of an interactive plush toy constructed in accordance with an embodiment of the present invention and with a brim of its hat in a raised position;

FIG. 2 is a front perspective view of the interactive plush toy of FIG. 1 with the brim of its hat in a lowered position;

FIG. 3 is a bottom perspective view of the interactive plush toy of FIG. 1 with an access panel in an open position;

FIG. 4 is an enlarged fragmentary perspective view of the plush toy of FIG. 1 with portions of the hat made transparent to reveal components of an activation mechanism;

FIG. 5 is a side elevation view of the plush toy of FIG. 1;

FIG. 6 is an enlarged fragmentary top plan cross-sectional view taken along the line 6-6 of FIG. 5;

FIG. 7 is an enlarged side elevational view of a magnetic reed switch of the activation mechanism taken along the line 7-7 of FIG. 6;

FIG. 8 is a front elevational view of the plush toy of FIG. 1 with electrical components thereof illustrated in dashed lines;

FIG. 9 is a portion of a flow diagram illustrating a play sequence of an interactive toy according to an embodiment of the invention;

FIG. 10 is a continuation of the flow diagram of FIG. 9;

FIG. 11 is a continuation of the flow diagram of FIG. 10; and

FIG. 12 is a continuation of the flow diagram of FIG. 11 and illustrates the trial mode play sequence.

DETAILED DESCRIPTION OF THE INVENTION

Figure 1:
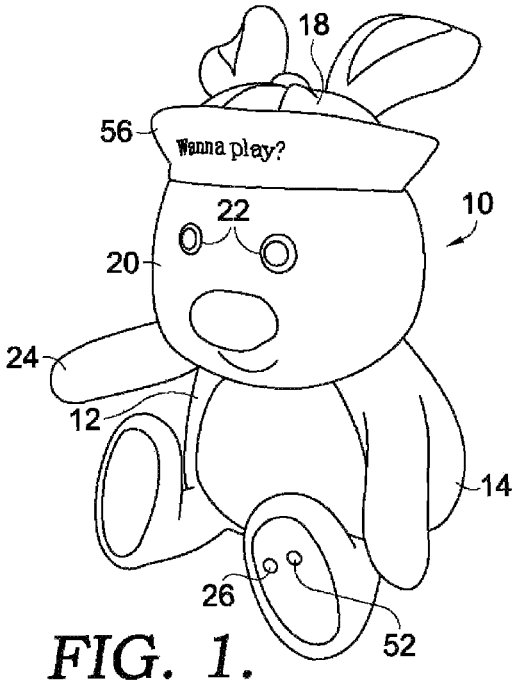

Referring now to the drawings in more detail and initially to FIG. 1, numeral 10 generally designates an interactive toy constructed in accordance with the present invention. The toy 10 can be of any material or construction, but in the illustrative embodiment disclosed herein, the toy 10 is a plush toy having a body 12 with a soft, furry exterior 14 and is filled with stuffing 16. The toy 10 includes a hat 18 on top of a head 20 of the body 12. The head 20 has a pair of eyes 22. The body 12 also includes a plurality of limbs 24. It should be understood that limb as used herein can mean leg or arm, but should also be understood in its broadest sense to mean any outwardly extending portion of a toy (e.g., ears, tails, nose, etc.).

Figure 3:
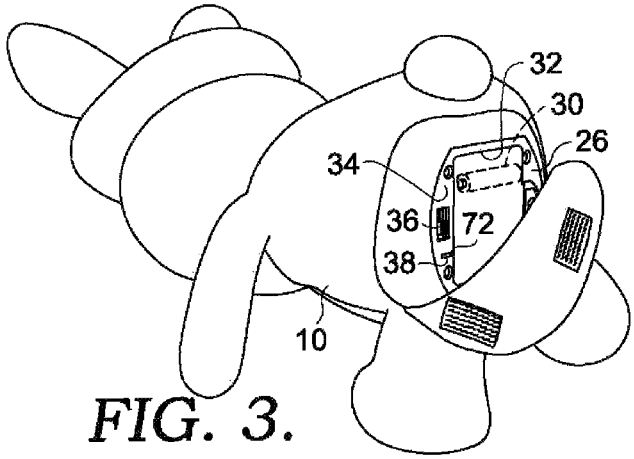

The toy 10 also includes a number of electrical components 26 generally concealed in an interior cavity 28 of the body 12. The electrical components 26 permit the toy 10 to play audible messages which direct the interaction of the user with the toy 10. The electrical components 26 preferably include one or more batteries 30 positioned in a battery compartment 32 for powering the electrical components 26. As illustrated best in FIG. 3, the battery compartment 32 is part of a battery housing 34. The battery housing preferably also includes a main power switch 36, for controlling the delivery of electrical power to the remainder of the electrical components 26, and a pull tab switch 38, which provides the toy 10 with a trial mode which will be discussed in greater detail below.

Figure 8:
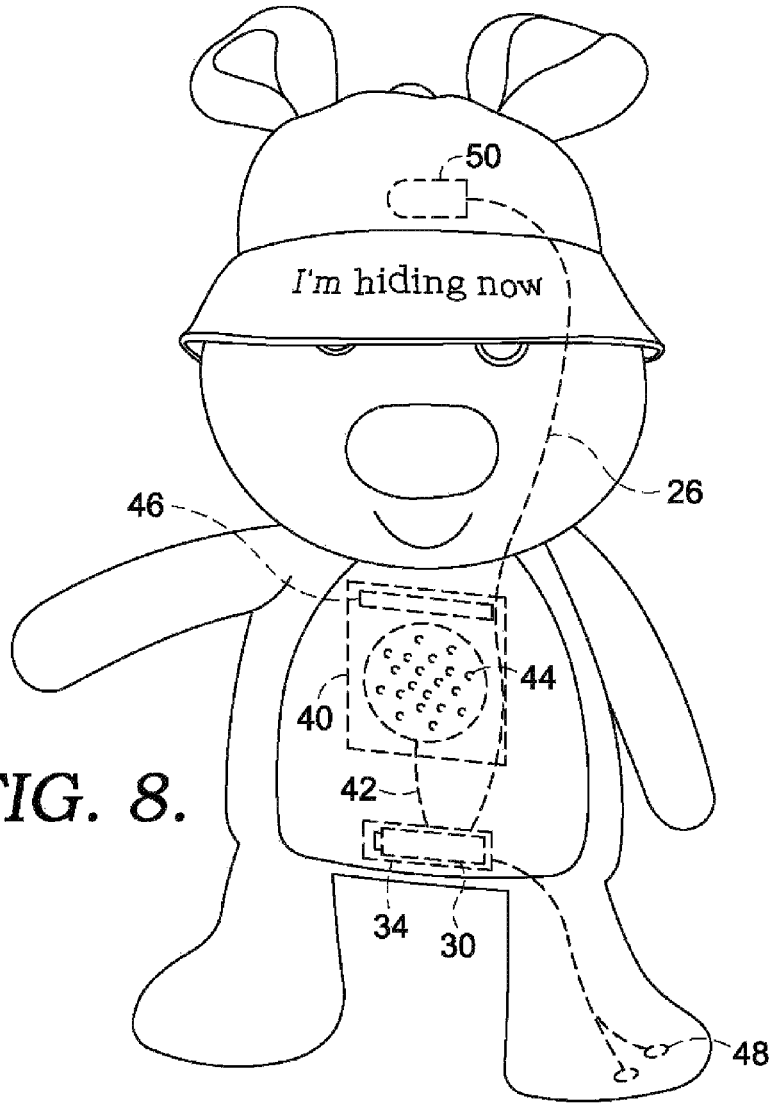
Figure 9:
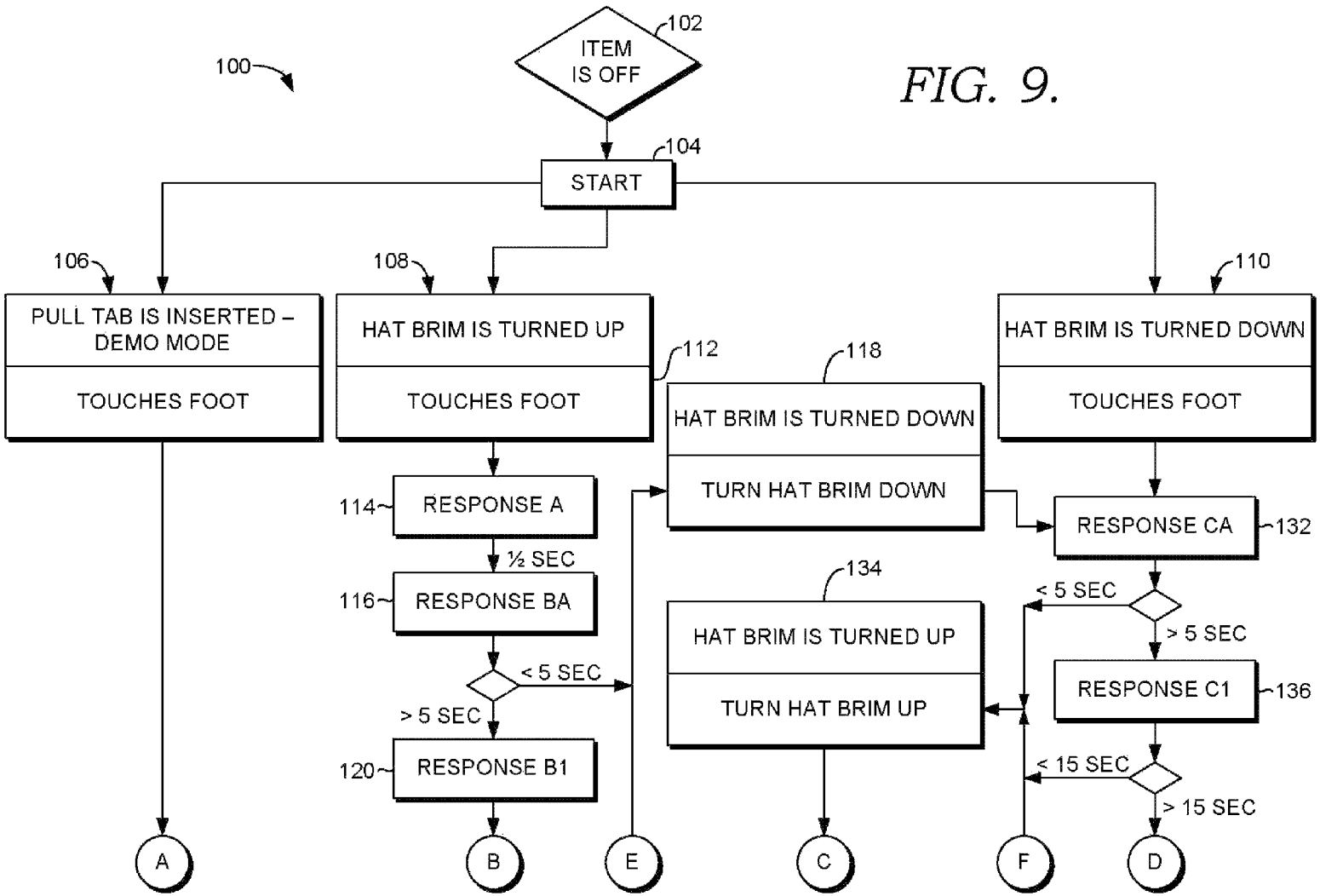
Figure 10:
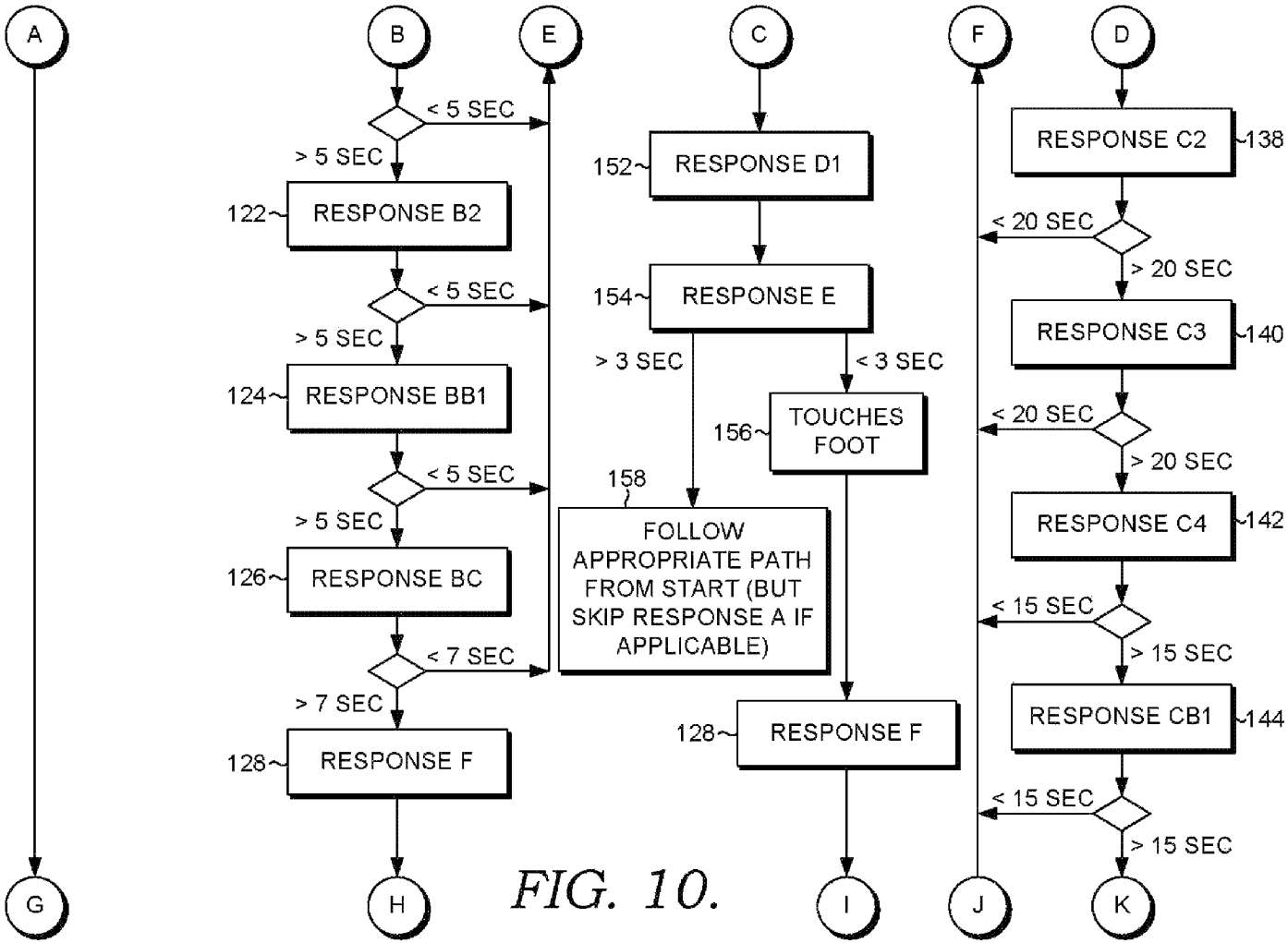
Figure 11:
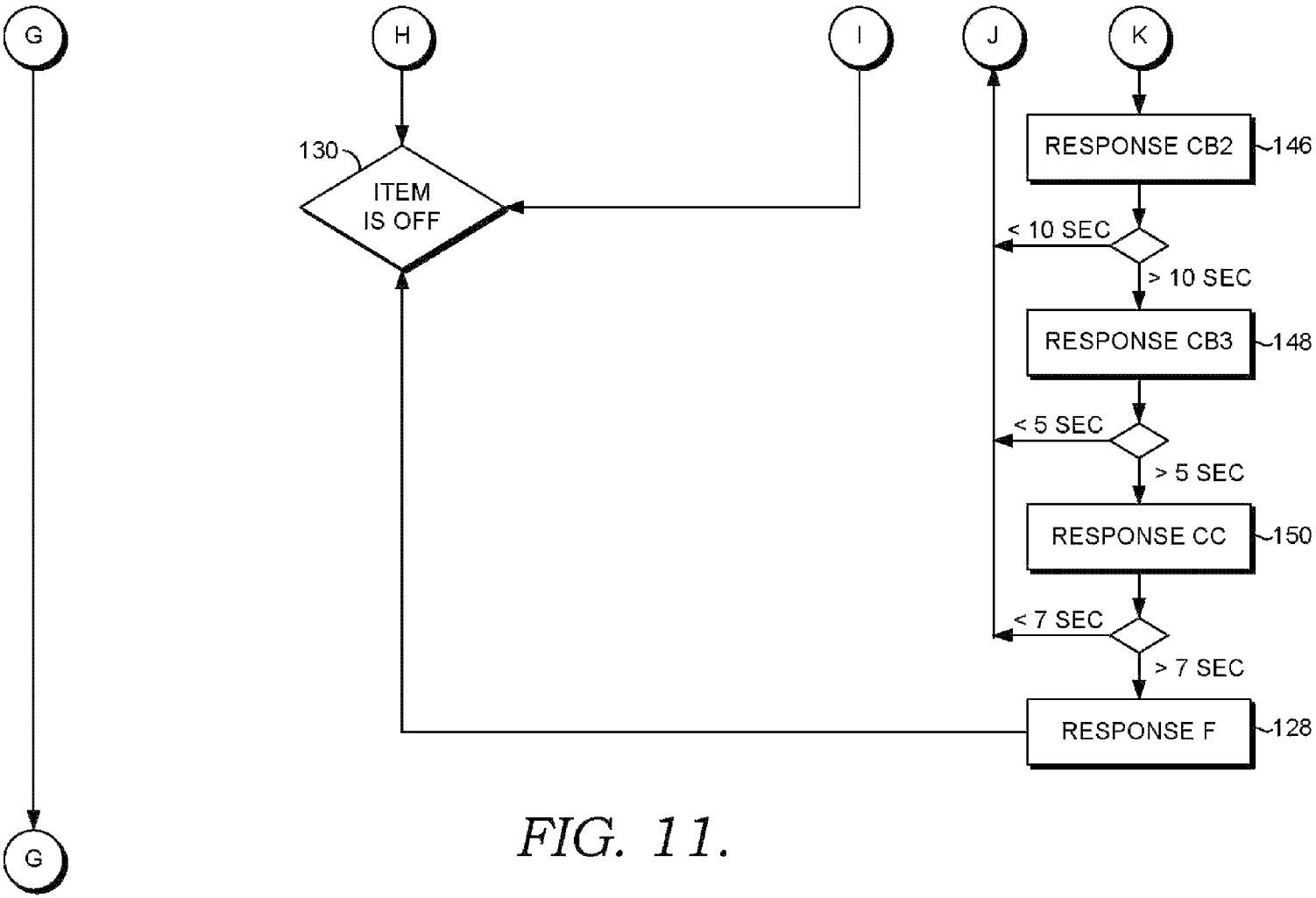

The electrical components 26 also preferably include a sound module 40 positioned within the interior cavity 28 of the body 12 and electrically coupled with the battery housing 34 by a plurality of wires 42, as best illustrated on FIG. 8. The sound module 40 preferably includes a speaker 44, a controller 46, and various related circuitry (not shown). The related circuitry works with the controller 46 to permit the controller 46 to activate the speaker 44 and to play audio messages stored in the controller 46 in a manner known to one of ordinary skill in the art.

The electrical components 26 further include an activation switch 48 and an activation mechanism 50. The activation switch 48 is preferably provided in a limb 24 of the body 12 and has a user engagable portion 52, whereby the user can initiate a play session with the toy 10. In the illustrated embodiment, the activation switch 48 is shown as a touch sensing switch with a pair of contact points 54 that are accessible by user on the exterior 14 of the body 12 of the toy 10. Other types of switches may be used to activate the toy 10 and initiate a play session as would be readily understood by one of ordinary skill in the art. The activation switch 48 can also be used to restart a particular play mode, thereby giving the user more time (e.g., if the user has not yet found a hiding place when it is getting ready to turn off).

The activation mechanism 50 includes an electrical component 26 and permits the controller 46 to determine the position of a feature 56 of the toy 10. By determining the position of a feature 56 of the toy 10, the controller 46 is thereby able to play different audio messages based on the position of the feature 56 and thereby change play sequences of the toy 10 based on a user's interaction with the toy by way of changing the position of the feature 56 of the toy.

In the illustrated embodiment, the activation mechanism 50 takes the form of a magnetic field sensor or magnetic switch 58 and a magnet 60. By providing one of the magnetic switch 58 or the magnet 60 in a feature 56 that is moveable with respect to the body 12, the two components of the activation mechanism 50 can be moved toward and away from each other by movement of the feature 56 of the toy 10. In the illustrated embodiment, the feature 56 is a brim 62 of the hat 18. In other embodiments of an interactive toy, the feature could be a limb 24 or other moveable portion of the interactive toy.

Figure 2:
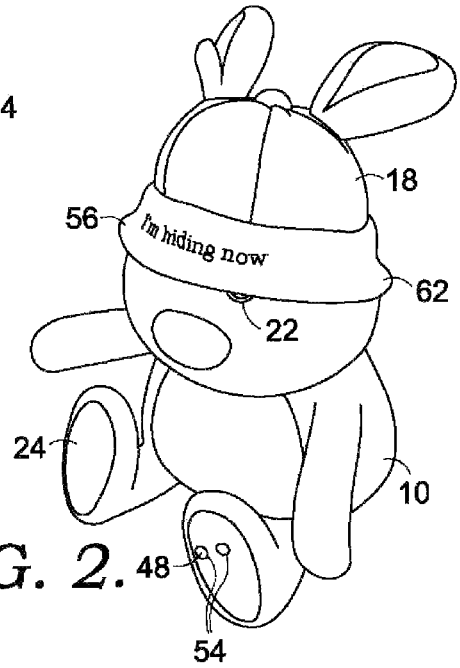
Figure 6:
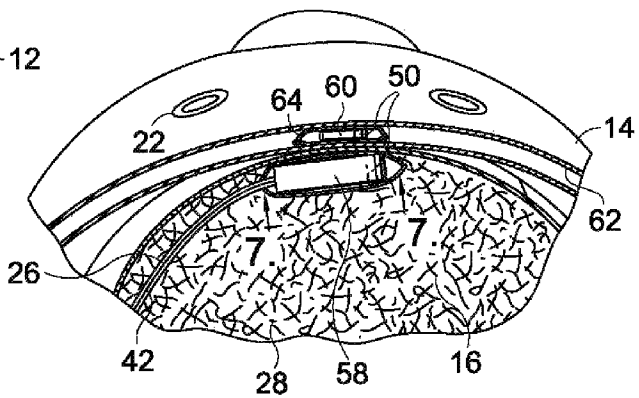
Figure 4:
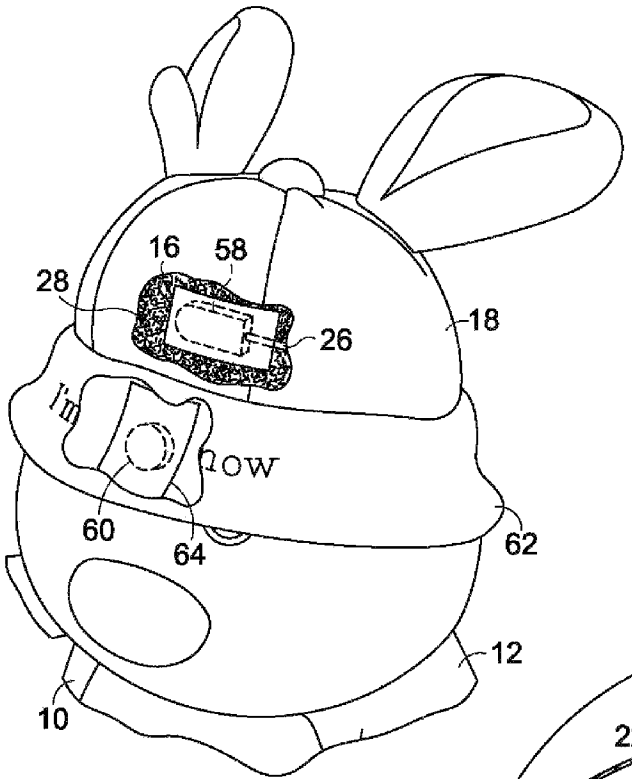

As illustrated in FIGS. 1 and 2, the feature 56 or brim 62 of the hat 18 is moveable from a first or up position (illustrated in FIG. 1) to a second or down position (illustrated in FIG. 2). As best illustrated in FIGS. 4 and 6, the magnet 60 of the activation mechanism 50 has been positioned inside the brim 62 of the hat 18. For ease of assembly and to secure the position of the magnet 60 in the brim 62, the magnet 60 may be sewn into a cloth pocket 64 which itself may be sewn to the brim 62 of the hat 18. It should be readily understood that other methods of securing the magnet 60 in a particular location within the brim 62 are within the scope of the present invention (e.g., adhesive, sewing without a pocket, etc.). It should also be readily understood that the magnetic switch 58 could be positioned in the brim 62 and the magnet 60 be positioned inside the head 20 of the body 12. However, the embodiment illustrated avoids the necessity of having to run wires 42 into the user movable brim 62 of the hat 18.

Figure 5:
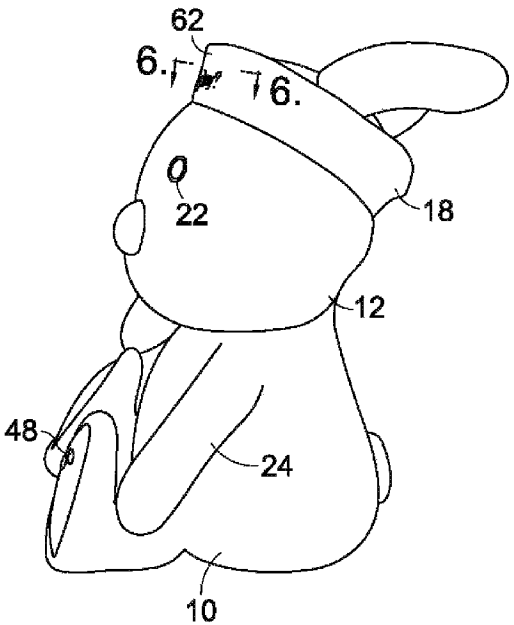
Figure 7:
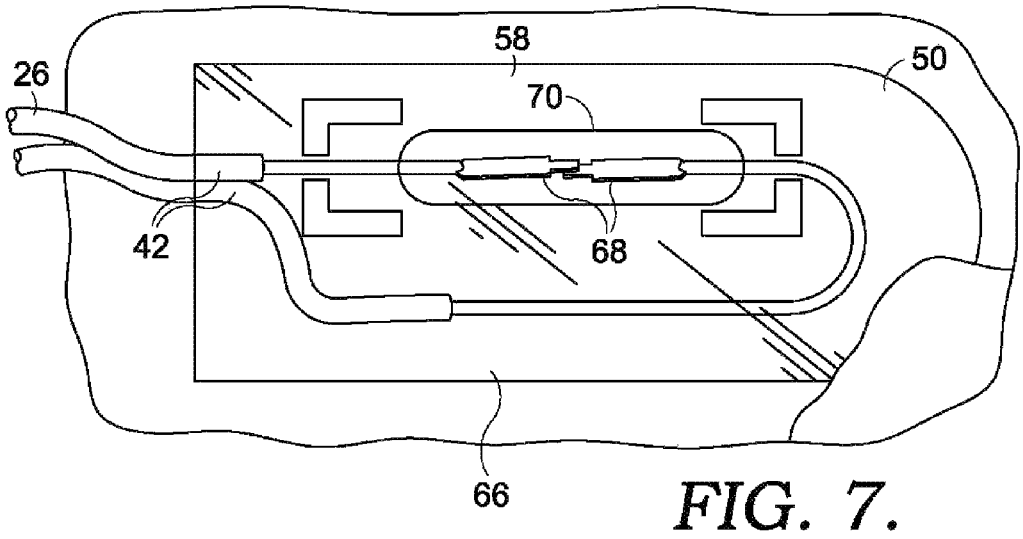

The magnetic switch 58, as best illustrated in FIG. 7, may take the form of a reed type magnetic switch. The reed type magnetic switch 58 includes a casing 66 into which a pair of wires 42 are secured. Ends of the wires 42 terminate in electrical contacts or reeds 68 that are encased inside a capsule 70. This particular magnetic switch 58 in the illustrated embodiment is constructed such that the reeds 68 are normally in a non-abutting position in the absence of a magnetic field. It should be understood that an alternate reed switch, where the reeds are normally in an abutting position in the absence of a magnetic field, could be used. With the illustrated magnetic switch 58, when the reeds 68 encounter a magnetic field, such as the one produced by the magnet 60, the reeds 68 are moved together and into a abutting contact, thereby completing an electrical circuit. Accordingly, when the brim 62 of the hat 18 is in the up position illustrated in FIGS. 1, 5 and 6, such that the magnet 60 is adjacent the magnetic switch 58, the reeds 68 are in a abutting contact and create a closed electrical circuit. When the brim 62 of the hat 18 is turned down, such as illustrated in FIGS. 2, 4 and 8, the magnet 60 is moved away from the magnetic switch 58 and the reeds 68 return to their naturally spaced apart position, thereby creating an open circuit. The controller 46 senses whether the activation mechanism 50 provides an open circuit or a closed circuit and plays audio messages in accordance therewith, as discussed in greater detail below.

Turning now to FIGS. 9-12, a flow diagram illustrating a method 100 of playing with the toy 10 as shown. At step 102, the toy 10 is in an off position. This is generally accomplished by the main power switch 36 being in an off position. To begin play, the user, at step 104 activates the toy 10 by moving the main power switch 36 to an on position. At this point, the toy 10 is ready to operate in one of three possible play sequences or modes. The play sequences are: A trial mode 106, a "hide me" mode 108, and a "locate me" mode 110. The trial mode 106, as briefly mentioned above, is an optional feature for the toy 10 that allows the toy 10 to operate in a pared down demonstration mode while the toy 10 is in a store for sale. The trial mode 106 allows the toy 10 to operate in an abbreviated format to give potential purchasers a small sampling of the features and phrases the toy 10 provides. The trial mode 106 saves battery life on the toy 10 while in the store and reduces the length of time the toy 10 will produce audible sounds while unattended. Whether the toy 10 operates in the trial mode 106 or not is determined by the state of the pull tab switch 38. A pull tab switch 38 includes a pair of contacts (not shown) that are normally in abutting contact, thereby representing a closed circuit. When providing a closed circuit, the controller 46 operates in the full featured non-trial mode of either the "hide me" mode 108 or the "locate me" mode 110. However, when the toy is shipped for initial sale, a pull tab (not shown) is inserted between the contacts of the pull tab switch 38 to separate the contacts of the pull tab switch 38, thereby providing an open circuit that is sensed by the controller 46. The pull tab is inserted between the contacts through a slot 72 in the battery housing 34. Once the toy 10 is purchased and removed from its retail packaging, the pull tab may be pulled out of the slot 72, thereby completing the circuit of the pull tab switch 38 and providing the user with the full feature modes of the toy 10.

As discussed above, the position of the brim 62 of the hat 18 determines the play sequence and in turn the audio commands that are provided by the toy 10. At step 112 the user activates the toy 10 by touching the contact points 54 of the activation switch 48 with the brim 62 of the hat 18 in its up position, thereby initiating the "hide me" mode 108. At step 114, the controller 46 plays an audible message identified as RESPONSE A. RESPONSE A is a message that informs the user that they have activated the toy 10 to play a hide and seek game. An exemplary RESPONSE A message would be: "Hello. Want to play hide and seek? I do." At step 116 the user is instructed to hide the toy 10 by an audible message identified as RESPONSE BA. An exemplary message for RESPONSE BA would be: "Ready, set, hide!"

Subsequent to step 116, the user looks for a place to hide the toy 10. Upon finding a place to hide the toy 10, the user moves the brim 62 of the hat 18 from its up position to its down position, thereby moving the magnet 60 away from the magnetic switch 58 and opening the circuit of the activation mechanism 50, at step 118. The opening of the circuit of the activation mechanism 50 is sensed by the controller 46 and the controller 46 switches to the "locate me" mode 110.

If the user has not located a desirable place to hide the toy 10 within a predetermined length of time and indicated the same by turning the brim 62 of the hat 18 down at step 118, the controller 46 plays an audible message at step 120 identified as RESPONSE B1. An exemplary audio message or RESPONSE B1 is: "Hmm, where should I hide? Where, where, where?" If the user does not turn the hat brim down at step 118 within a predetermined time subsequent to step 120, a second audible message, identified as RESPONSE B2, is played at step 122. An exemplary RESPONSE B2 is: "Help me find a good hiding place." It should be noted that other messages could be played for RESPONSE B1 and B2 that direct the user to hide the toy 10. Additionally, to provide the toy with improved interaction and an appearance of spontaneity, additional RESPONSE B messages can be stored in the controller 46. For example, the controller 46 can also include a RESPONSE B3 and a RESPONSE B4. The controller 46 can also be provided with a counter that remembers the last RESPONSE B message that was played such that the audible messages provided in the "hide me" mode 108 are not always the same each time the user plays with the toy 10. Exemplary RESPONSE B3 and B4 messages are: "Let's be very, very sneaky" and "I love hiding, hiding's fun. Doo-dah, doo-dah."

If the user has still not turned the hat brim down at step 118, the toy 10 provides an audible message at step 124 identified as RESPONSE BB1. The RESPONSE BB1 has a heightened sense of anxiety to indicate that the time for hiding the toy 10 is drawing to a close. An exemplary audible message for RESPONSE BB1 is: "We better find a good hiding place quick." An alternate RESPONSE BB can be stored in the controller 46, again so that the toy does not provide the same messages each time it is used. An exemplary RESPONSE BB2 message is: "Hurry up. Let's find a good hiding place." If the user has still not turned the hat down at step 118, the controller 46 plays a warning message at step 126 identified as RESPONSE BC. An exemplary RESPONSE BC is "Last chance to hide me." If the user still does not turn the hat down at step 118 within an allotted time period, the controller 46 plays an audible message at step 128 indicating that the toy 10 is turning off. An exemplary RESPONSE F is: "See you later." Subsequent to the playing of RESPONSE F at step 128, the controller 46 turns the toy 10 off at step 130. At this point, movement of the brim 62 of the hat 18 does not affect the play of the toy 10. The toy 10 will remain in the off state until it is reactivated by the user touching the contact points 54 of the activation switch 48. It should be noted that the toy 10 can be programmed so that the activation switch 48 can be used to reset the current play sequence to give the user more time. For example, at any time between step 116 and step 128 in the "hide me" mode 108, the user can touch the contact points 54 to reset the "hide me" mode 108 play sequence and get more time to hid the toy 10. Upon touching the contact points, the current play sequence would start over, in this case at step 120.

If the user found a suitable hiding place and turned the brim of the hat down at step 118 at some point prior to step 128 in the "hide me" mode 108, the controller 46 switches to the "locate me" mode 110 and provides an audible message at step 132 identified as RESPONSE CA. RESPONSE CA signals to the user that the toy 10 recognizes that it has been hidden. An exemplary RESPONSE CA is: "I'm hiding now." Upon the playing of the RESPONSE CA at step 132, the toy begins to periodically voice audible messages at various intervals instructing a seeker to find the toy 10. Upon finding the toy 10, the seeker indicates the same by turning the hat brim up at step 134. If the seeker does not indicate that they have found the toy 10 in a predetermined time after step 132 by turning the hat brim up at step 134, the controller 46 plays an audible message identified as RESPONSE C1 at step 136. An exemplary RESPONSE C1 is a whistling sound of the type used to get someone's attention.

If the seeker does not indicate that they have found the toy 10 in a predetermined amount of time subsequent to step 136 by turning the hat brim up at step 134, a second message is played at step 138 identified as RESPONSE C2. An exemplary RESPONSE C2 is: "Yoo-hoo." If the brim 62 of the hat 18 is not turned up in a predetermined amount of time following step 138, the controller 46 plays an audible message identified as RESPONSE C3 at step 140. An exemplary RESPONSE C3 is: "I'm over here!" If the seeker still does not indicate that they have located the toy 10 by turning the brim of the hat up in step 134 within a predetermined time, the controller 46 plays an audible message identified as RESPONSE C4 at step 142. An exemplary RESPONSE C4 is: "Peek-a-boo. Where are you?" As with the multiple different versions of RESPONSE B, the controller 46 can also store multiple versions of RESPONSE C and keep track of where it left off to mix up the play sequence of the RESPONSE C messages. In that regard, the controller 46 can also store a message RESPONSE C5. An exemplary RESPONSE C5 is: "I'm waiting for you."

If the seeker has still not indicated that they have located the toy 10 by turning its hat brim up at step 134, the controller 46 plays a RESPONSE CB having a message with a heightened anxiety indicating that the time for finding the toy 10 before it turns off is drawing closer. At step 144, the controller 46 plays a message identified as RESPONSE CB1. An exemplary message for RESPONSE CB1 is: "Hello out there. Anybody home?" At step 146, an audible message identified as RESPONSE CB2 is played if the seeker does not indicate that they have found the toy 10 by turning the hat brim up at step 134. An exemplary RESPONSE CB2 is: "Are you still looking?" To further increase the heightened sense of urgency provided by the messages identified as RESPONSE CB, the time between subsequent RESPONSE CB messages is shortened. At step 148, an audible message identified as RESPONSE CB3 is played. An exemplary RESPONSE CB3 message is: "It's getting past my bedtime." As discussed above in connection with various other responses, additional RESPONSE CB messages can be stored in the controller 46 and played in a changing order to alternate the vocal commands provided in subsequent playing of the "locate me" mode 110. Additional messages which can be identified as RESPONSE CB4, RESPONSE CB5, and RESPONSE CB6 are: "La la la la la, come get me!", "I'm getting lonely!" and "Hey! Hurry up!"

If the seeker has still not indicated that they have found the toy 10 by turning its hat brim up at step 134, a warning message, identified as RESPONSE CC, is played at step 150. An exemplary RESPONSE CC message is: "Okay. Last chance to find me." If the seeker does not indicate finding of the toy 10 within a predetermined time after step 150, the controller 46 initiates the playing of a message identified as RESPONSE F at step 128 and turns off the toy 10 at step 130. As before, the activation switch 48 can not only be used to subsequently turn the toy back on after step 130, but the activation switch 48 can be used during the "locate me" 110 play sequence to give the seeker more time to find the toy. Accordingly, if the user touches the contact points 54 at any point in the "locate me" 110 play sequence after step 136 and before step 128 is initiated after step 150, the toy 10 will revert to step 136 and proceed back down the play sequence.

If the seeker indicates a finding of the toy 10 by turning the hat brim 62 up at step 134 at any point between step 132 and step 150, or shortly after step 150, the controller 46 plays an audible message identified as RESPONSE D1 at step 152. An exemplary RESPONSE D1 message is: "You found me! Woo-hoo!" At step 154 the controller 46 plays a message, identified as RESPONSE E, informing the user of the option to stop playing with the toy 10. An exemplary RESPONSE E is: "Want to stop playing? Touch my foot." If the user touches the contact points 54 of the activation switch 48 in response to the message of step 154 within the allotted time at step 156, the controller 46 plays the message identified as RESPONSE F at step 128 and turns off the toy 10 at step 130. If the user does not signal a desire to cease playing with the toy 10 in response to the message at step 154 within the allotted time, the controller 46 returns to either the "hide me" mode 108 (most likely) or the "locate me" mode 110, depending on the position of the brim 62 of the hat 18 at step 158. The controller 46 will play either RESPONSE BA at step 116 or RESPONSE CA at step 132, again, depending on the position of the brim 62 of the hat 18.

Figure 12:
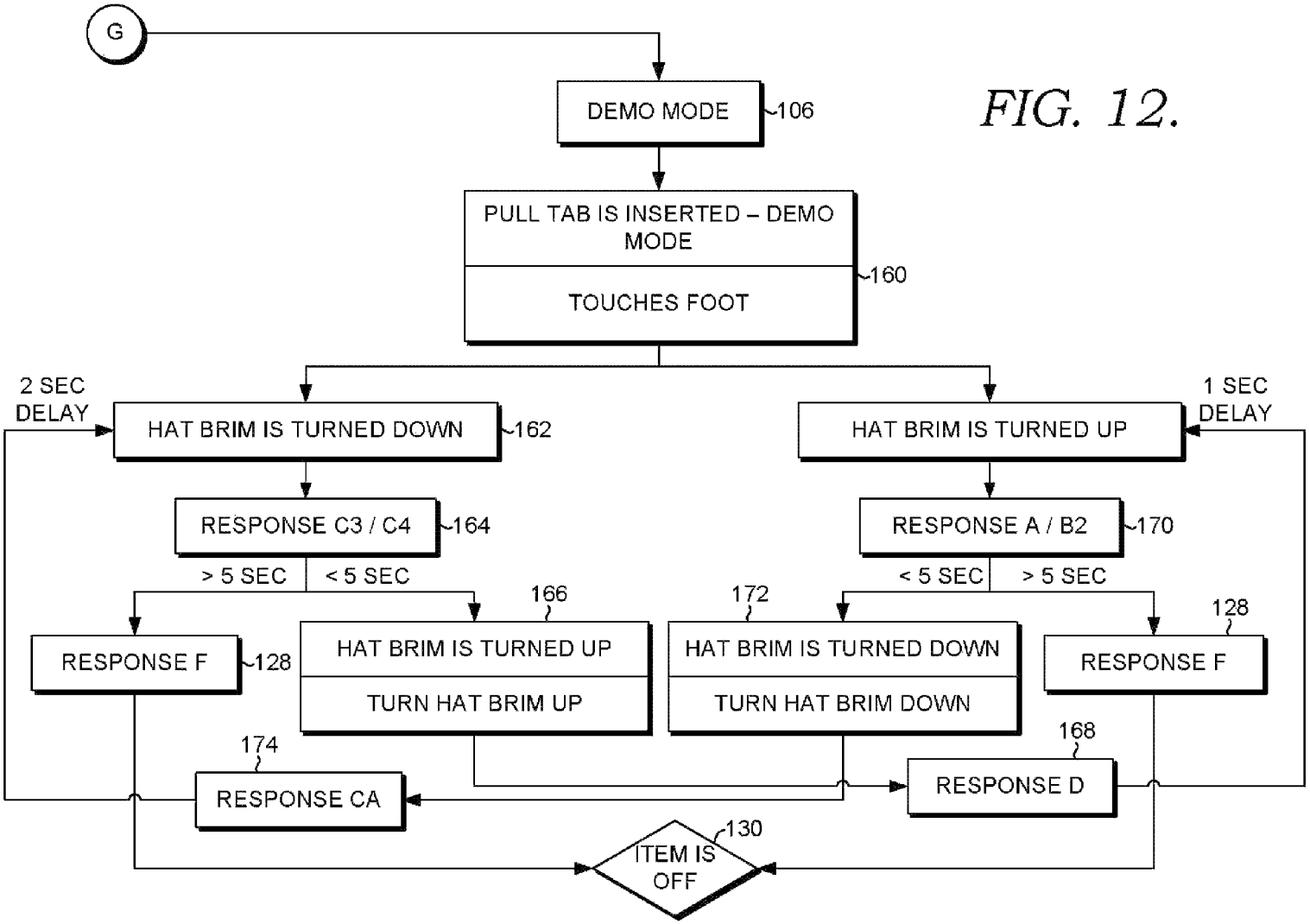

Turning now to FIG. 12, the trial or demo mode 106 will be discussed. Again, the trial mode 106 is played by the controller 46 upon the touching of contact points 54 of the activation switch 48 when a pull tab is inserted in the slot 72 between the contacts of the pull tab switch 38, indicated as step 160. In the trial mode 106, the response times are significantly decreased to show limited features in a short amount of time without the user having to wait through silence to see subsequent features.

If the brim 62 of the hat 18 is in the down position at step 162 after the potential purchaser activates the trial mode 106, the controller 46 plays either RESPONSE C3 or RESPONSE C4 at step 164. If the potential purchaser does not turn the brim 62 of the hat 18 up at step 166 within the allotted time (identified as 5 seconds), the controller 46 plays RESPONSE F at step 128 and the toy 10 is turned off at step 130. If the potential purchaser turns the hat brim 62 up at step 166 in the allotted time, the controller 64 plays RESPONSE D at step 168, thereby indicating that the potential purchaser "found" the toy 10. The controller 46 then moves to step 170 where an audible message, identified as RESPONSE A or B2, is played to instruct the potential purchaser to "hide" the toy 10 by turning the hat brim 62 down. If the hat brim 62 is not turned down in the allotted time, the controller 46 plays RESPONSE F at step 128 and the toy 10 is turned off at step 130. If the potential purchaser does turn the hat brim 62 down at step 172 in the allotted time, RESPONSE CA is played at step 174 and the controller 46 returns to step 164 and plays either RESPONSE C3 or RESPONSE C4.

From the foregoing it will be seen that this invention is one well adapted to attain all ends and objects hereinabove set forth together with the other advantages which are obvious and which are inherent to the method and apparatus. It will be understand that various modifications can be made and still stay within the scope of the invention. For example, instead of the brim 62 covering the eyes 22 in the "locate me" mode 110, the activation mechanism 50 could cooperate with one of the limbs 24 and it could be made to cover the eyes 22 to change the toy 10 to the "locate me" mode 110. It will also be understood that certain features and subcombinations are of utility and may be employed without reference to other features and subcombinations. This is contemplated by and is within the scope of the invention.

Since many possible embodiments may be made of the invention without departing from the scope thereof, it is to be understood that all matter herein set forth or shown in the accompanying drawings is to be interpreted as illustrative of applications of the principles of this invention, and not in a limiting sense.

What is claimed is:

1. An interactive toy comprising:

a body having an interior cavity;

electrical components for playing audible messages for directing interaction with the toy, wherein a portion of the electrical components are located in the cavity of the body, and wherein the electrical components include a speaker and a switch;

a feature that is a brim of a hat of the toy, wherein the feature is movable between a first position and a second position while the hat is on the body;

an activation mechanism for altering a play sequence of the toy, wherein the activation mechanism cooperates with the feature of the toy and wherein the position of the feature determines the play sequence of the toy, wherein the activation mechanism includes a magnetic switch electronically coupled to the electrical components and a magnet, wherein the magnet is movable toward and away from the magnetic switch, wherein one of the magnet and the magnetic switch are positioned in the feature of the toy, wherein the magnet and the magnetic switch are near each other when the feature is in its first position, wherein the magnet and the magnetic switch are spaced apart from one another when the feature is in its second position, and wherein movement of the feature alters the distance between the magnet and the magnetic switch.

2. An interactive toy comprising:

a body having an interior cavity;

electrical components for playing audible messages for directing interaction with the toy, wherein a portion of the electrical components are located in the cavity of the body, and wherein the electrical components include a speaker and a switch;

a feature that is a brim of a hat of the toy, wherein the feature is movable between a first position and a second position while the hat is on the body;

an activation mechanism for altering a play sequence of the toy, wherein the activation mechanism cooperates with the feature of the toy and wherein the position of the feature determines the play sequence of the toy, and wherein a portion of the activation mechanism is located in the feature.

3. The toy of claim 2, wherein the toy includes eyes in a head portion of the body, wherein the brim is in an up position and the eyes are visible when the brim is in the first position, and wherein the brim is in a down position and the eyes are covered by the brim when the brim is in the second position.

4. The toy of claim 3, wherein the activation mechanism includes a magnetic switch electronically coupled to the electrical components and a magnet, and wherein one of the magnetic switch and the magnet are located in the brim of the hat.

5. The toy of claim 2, wherein the switch is a power switch and wherein the electrical components further include a battery compartment and an activation switch.

6. The toy of claim 5, wherein the activation switch is located in a limb of the toy and is accessible by a user to activate the toy.

7. The toy of claim 2, wherein the electrical components further include a controller having audio messages stored therein and wherein different messages are played depending on the position of the feature of the toy.

8. A method of playing a game with an interactive toy, wherein the toy includes a feature movable between a first position and a second position, the method comprising:

activating the toy with the feature in a first position, wherein the toy is in a hide mode when the feature is in the first position and wherein the toy produces audible messages instructing the user to hide the toy when the toy is in the hide mode and the feature is in the first position; and moving the feature to the second position upon finding a location to hide the toy, wherein the toy is in a locate mode when the feature is in the second position and wherein the toy produces audible messages instructing a seeker to find the toy when the toy is in the locate mode and the feature is in the second position.

9. The method of claim 8, further comprising moving the feature to the first position upon finding the toy, wherein the toy produces audible messages indicating that it has been found.

10. The method of claim 8, wherein the feature is a brim of a hat of the toy.

11. The method of claim 10, wherein the brim, when in the second position, is folded down and wherein the brim includes a portion of an activation mechanism.

12. The method of claim 11, wherein the activation mechanism includes a magnetic switch and a magnet, wherein one of the magnetic switch and the magnet are located in the brim of the hat, and wherein moving the brim between the first and second positions moves the magnetic switch and the magnet toward and away from each other, thereby activating and deactivating the magnetic switch.

13. The method of claim 8, wherein the feature is a brim of a hat of the toy, wherein the brim includes a magnet, wherein a head of the toy includes a magnetic switch therein, wherein the magnetic switch detects the presence of the magnet when the brim is turned up, wherein the sensor does not detect the presence of the magnet when the brim is turned down, and wherein the position of the brim determines whether the toy is in the hide mode or the locate mode.

14. An interactive toy comprising:

a toy body having an interior cavity;

a sound module positioned within the cavity, the module having a speaker and a controller with a plurality of audio messages stored therein for selective playback via the speaker, wherein the messages direct a user how to interact with the toy;

a power source electronically coupled with the sound module for providing electrical power thereto;

a user engagable switch for initiating interaction with the toy;

a feature of the toy movable between first and second positions; and an activation mechanism having a magnetic switch and a magnet, wherein one of the magnetic switch and the magnet are located in the feature, and wherein moving the feature between the first and second positions moves the magnetic switch and the magnet toward and away from each other, thereby activating and deactivating the magnetic switch;

wherein the sound module plays messages directing the user to hide the toy when the feature is in the first position and wherein the sound module plays messages directing the user to find the toy when the feature is in the second position.

15. The toy of claim 14, wherein the toy includes eyes in a head thereof and wherein the feature covers at least a portion of the eyes when it is in the second position.

16. The toy of claim 15, wherein the feature is a brim of a hat of the toy and wherein the brim is movable from an up position where the sound module plays messages directing the user to hide the toy to a down position where the brim covers at least a portion of the eyes and the sound module plays messages directing the user to find the toy.

17. The toy of claim 16, wherein the magnetic switch is a reed switch located in the head of the toy and wherein the magnet is located in the brim of the hat.

18. The toy of claim 14, wherein the position of the feature determines which audio messages stored in the controller are played back.

* * * * *